US005829476A

United States Patent [19]

Kaneko et al.

[11] Patent Number: 5,829,476

[45] Date of Patent: Nov. 3, 1998

[54] DUAL-STREAM FILLING VALVE

[75] Inventors: Yutaka Kaneko, Arlington Heights; Adam M. Koller, Chicago; Sven Arne Anderssen, Buffalo Grove; Bengt Andersson, Palatine, all of Ill.

[73] Assignee: Tetra Laval Holdings & Finance, SA, Pully, Switzerland

[21] Appl. No.: 897,554

[22] Filed: Jul. 21, 1997

[51] Int. Cl.[6] ..... B67D 5/54; B67D 5/00

[52] U.S. Cl. ..... 137/606; 222/145.7

[58] Field of Search ..... 137/606; 222/134, 222/145.7

[56] References Cited

U.S. PATENT DOCUMENTS

| | | | |
|---|---|---|---|
| 2,134,200 | 10/1938 | Pivoto | 137/606 |
| 2,316,781 | 4/1943 | Fox | 137/606 |
| 2,325,242 | 7/1943 | Gordon | 137/606 |
| 2,537,119 | 1/1951 | Bauerlein et al. | 137/606 |
| 3,097,764 | 7/1963 | Loeser . | |
| 3,229,477 | 1/1966 | Erickson . | |
| 3,298,383 | 1/1967 | Cooper . | |
| 3,474,965 | 10/1969 | Coleman . | |
| 3,770,208 | 11/1973 | Mueller . | |
| 3,876,114 | 4/1975 | Hicks et al. | 222/145.7 |
| 3,954,091 | 5/1976 | Stumpp | 137/607 |
| 4,549,676 | 10/1985 | Gerich | 222/145.7 |
| 4,602,906 | 7/1986 | Grunenfelder | 137/607 |
| 4,635,825 | 1/1987 | Tulasne . | |
| 4,723,712 | 2/1988 | Egli et al. | 137/606 |
| 4,789,100 | 12/1988 | Senf . | |
| 4,880,313 | 11/1989 | Loquenz et al. | 137/606 |
| 4,911,195 | 3/1990 | Farnsworth et al. | 137/606 |
| 4,915,688 | 4/1990 | Bischof et al. | 137/606 |
| 5,163,476 | 11/1992 | Wessman . | |
| 5,179,970 | 1/1993 | Jarocki et al. . | |
| 5,188,019 | 2/1993 | Vahabpour | 222/145.7 |
| 5,221,026 | 6/1993 | Williams | 222/145.7 |
| 5,332,157 | 7/1994 | Proctor | 222/145.7 |

*Primary Examiner*—Denise L. Ferensic
*Assistant Examiner*—Joanne Y. Kim
*Attorney, Agent, or Firm*—Michael A. Catania

[57] ABSTRACT

A dual-stream filling valve is used in a flowable material filling apparatus to introducing at least two flowable materials into a container. The dual-stream filling valve defines a material flow path therethrough. The valve includes a primary filling tube having an inlet end and a discharge end and defining a primary filling tube internal flow region. The primary filling tube defines a first opening therein intermediate the inlet and discharge ends. A secondary filling tube has an inlet end and a discharge end and defines a secondary filling tube internal flow region. The secondary filling tube is positioned at least in part within the primary filling tube internal flow region, penetrating the primary filling tube through the first opening. The dual-stream valve includes a valve plug that includes a portion that is movable relative to the secondary filling tube between an opened state wherein flow communication is established between the internal flow regions of the primary and secondary filling tubes and a closed state wherein flow communication is terminated between the internal flow regions of the primary and secondary filling tubes. An actuator is provided for moving the valve plug portion between the opened and closed positions. The actuator is disposed fully external of the secondary filling tube flow region.

5 Claims, 6 Drawing Sheets

DUAL-STREAM FILLING VALVE

FIELD OF THE INVENTION

This invention pertains to a dual stream filling valve. More particularly, this invention pertains to a dual stream filling valve for introducing a plurality of flowable products into a container in a filling apparatus.

BACKGROUND OF THE INVENTION

Various types of filling apparatuses are known in the art. In one type of apparatus, two or more streams of, for example, liquid are introduced into a single package, such as milk and cream mixed together into a single container. Such mixing must be done in a controlled, metered manner to assure that the proper quantities and proportions of each are added to the container.

Consumers will readily recognize that milk is available having varying milk fat content, such as skim milk, "1%" and "2%" milk, as well as whole milk. The milk fat content is generally controlled by the proportion of cream to milk in the final product. Often, cream is added to skim milk to produce the various percentages of milk fat content. This is one exemplary process in which the dual-stream filling valve can be used. In such a process, the milk is referred to as the primary fluid and the cream is referred to as the secondary fluid. It will be recognized that such an arrangement can be used for flowable product other than milk, such as dried, particulate or powdered products, as well as a combination of such solid (e.g., particulate and powdered) and liquid materials.

In one known arrangement, the combination of primary and secondary fluids in a single container is carried out using a dual-stream valve. The dual-stream valve has concentric outer and inner filling tubes (primary and secondary, respectively) that are in communication with respective liquid storage tanks or reservoirs. To meter or control the amount of secondary fluid introduced into the container, a valve element, such as a plug, is positioned at the bottom of the secondary tube. In known configurations, the plug is moved or actuated by a rod that penetrates the secondary tube, and longitudinally traverses through the inside of the tube from the tube top to the bottom where it is joined with the valve plug. As is apparent from this arrangement, the rod that traverses through the filling tube requires space or volume that could otherwise be devoted to secondary fluid flow. Moreover, this arrangement positions moving, mechanical components directly in the secondary fluid, which is typically food product. In addition, penetration of the rod through each filling tube requires the use of one or more seals to assure that the food product is fully isolated from the environs.

While such known dual-stream valves function well, they can require considerable maintenance and inspection. As will be apparent, each such seal provides the opportunity for leakage. Moreover, as noted above, such systems require space within the secondary tube, which, consequently increases the diameter of the secondary tube. Additionally, known dual-stream filling arrangements can create localize spots or locations that tend to promote undesirable accumulation of food product.

Accordingly, there continues to be a need for a dual-stream filling valve that does not impact or reduce the usable space or volume of the secondary filling tube or conversely require an increase in the diameter of the tube. Such a dual-stream valve has a minimum of moving mechanical parts that directly contact the flowable material in the system, typically a food product. Moreover, such a dual-stream valve minimizes the number and complexity of the seals required which, in turn, reduces the opportunity for leakage into and out of the valve.

SUMMARY OF THE INVENTION

A dual-stream filling valve is used in a flowable material filling apparatus for introducing at least two flowable materials into a container. The dual-stream filling valve defines a material flow path therethrough. The valve includes a primary filling tube having an inlet end and a discharge end and defines a primary filling tube internal flow region. The primary filling tube has a first opening therein intermediate the inlet and discharge ends.

A secondary filling tube has an inlet end and a discharge end and defines a secondary filling tube internal flow region. The secondary filling tube is disposed at least in part within the primary filling tube internal flow region. The secondary tube penetrates the primary filling tube through the first opening and is preferably positioned such that the discharge end is within the primary filling tube internal flow region.

Valve means, such as a valve plug, is operable relative to the secondary filling tube, and can be positioned in the primary filling tube internal flow region. The plug includes a portion that is movable relative to the secondary filling tube between an opened state wherein flow communication is established between the internal flow regions of the primary and secondary filling tubes and a closed state wherein flow communication is terminated between the internal flow regions of the primary and secondary filling tubes.

The dual-stream valve includes a valve actuator for moving the valve plug between the opened and closed positions. The actuator is disposed fully external of the secondary filling tube flow region.

In one embodiment, the primary and the secondary filling tubes are stationary relative to one another. The valve can include an actuating lever extending at least in part through a second opening in the primary filling tube. The lever is operably connected to the valve plug to move the plug between the opened and closed positions. Preferably, the actuating lever penetrates the primary filling tube intermediate the first opening and the inlet end.

In such an embodiment, a connecting member extends between the actuating lever and the valve plug, which is preferably a valve ball, to support the ball. The connecting member can be configured as a caged rod assembly to support the valve ball so that the ball freely rotates within the cage. Advantageously, in such a configuration, the valve ball is self-aligning and self-cleaning.

In an alternate embodiment, the valve plug is fixedly mounted to the primary filling tube proximal to the discharge end. The primary filling tube includes a stationary upper body portion, a stationary lower body portion and a reciprocating intermediate housing portion between the stationary upper and lower body portions. The intermediate housing is connected to the upper and lower stationary body portions by cooperating, preferably sliding joints.

The secondary filling tube penetrates the primary filling tube at the intermediate housing and reciprocates with the intermediate housing relative to the valve plug by movement of the cooperating joints. In a preferred arrangement, this embodiment of the dual-stream valve includes diaphrams that extend about the cooperating joints to isolate the sliding joints from the flowable material in the valve. A preferred configuration of the sliding joints includes annular inner and outer sliding members.

The valve plug can be formed as a valve cone. A well suited cone includes at least one, and preferably four V-grooves that extend along the length of the cone from the top of the cone downward. The V-grooves have a cross-sectional area that decreases along the length of the cone.

In still another embodiment of the dual-stream valve, the secondary filling tube is stationary relative to the primary filling tube and is positioned relative to the primary filling tube so as to define a sealed passage therebetween. The valve plug includes a pressure responsive seat element that moves, relative to the secondary filling tube, between the closed position and the opened position. Preferably, the seat element is operably connected to a biasing element to bias the seat element in either the opened or closed positions.

Pressure can be provided to the seat element by a gas, such as air or nitrogen. Alternately, the pressure responsive seat element can be configured to operate by vacuum. In still another configuration, the pressure responsive seat element can be actuated by a liquid, e.g., hydraulic system.

Other features and advantages of the present invention will be apparent from the following detailed description, the accompanying drawings, and the appended claims.

DETAILED DESCRIPTION OF THE PREFERRED EMBODIMENTS

Figure 1:
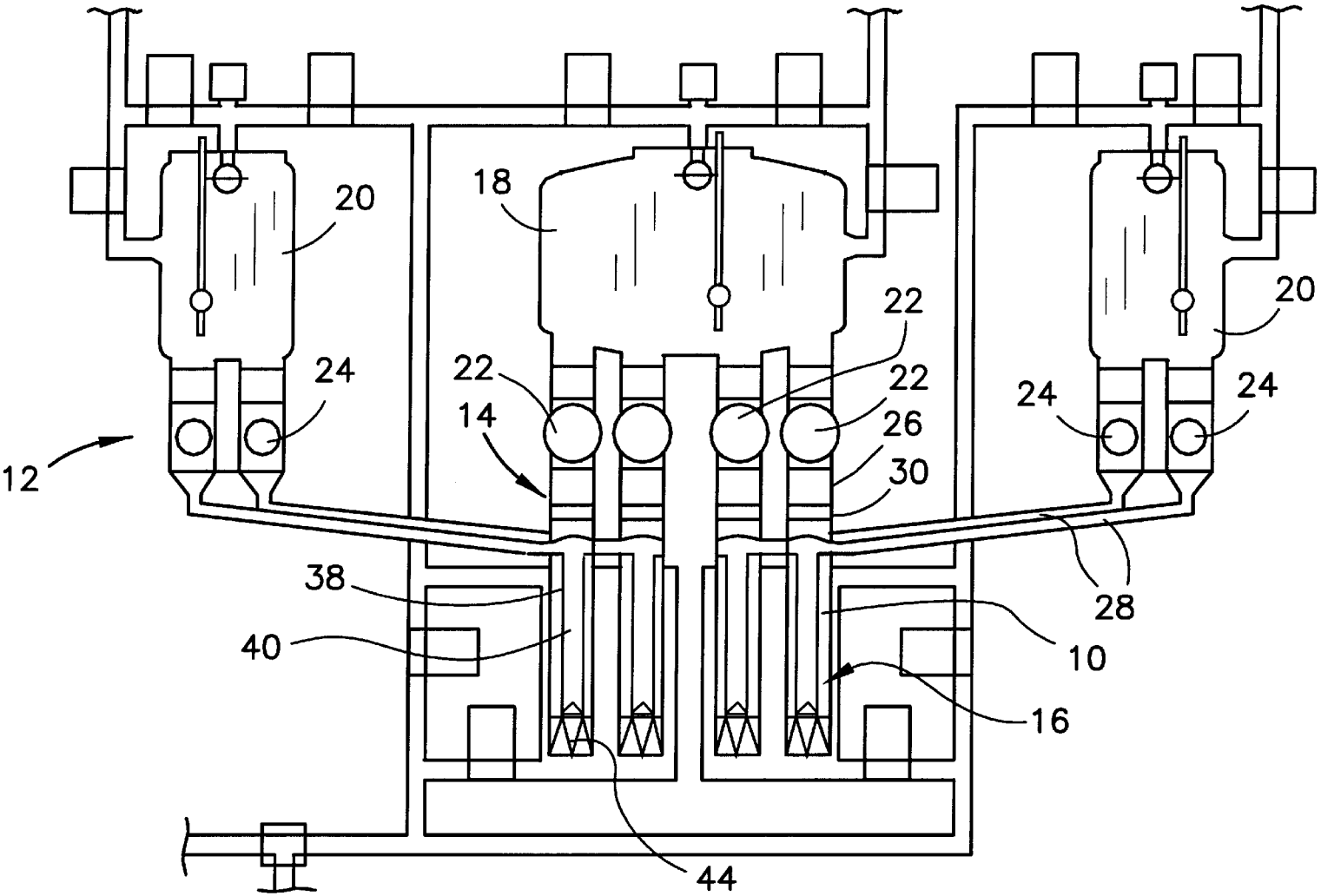
FIG. 1 is a schematic illustration of a flowable material filling apparatus for introducing two flowable materials into a container, which apparatus uses a dual-stream filling valve.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 2:
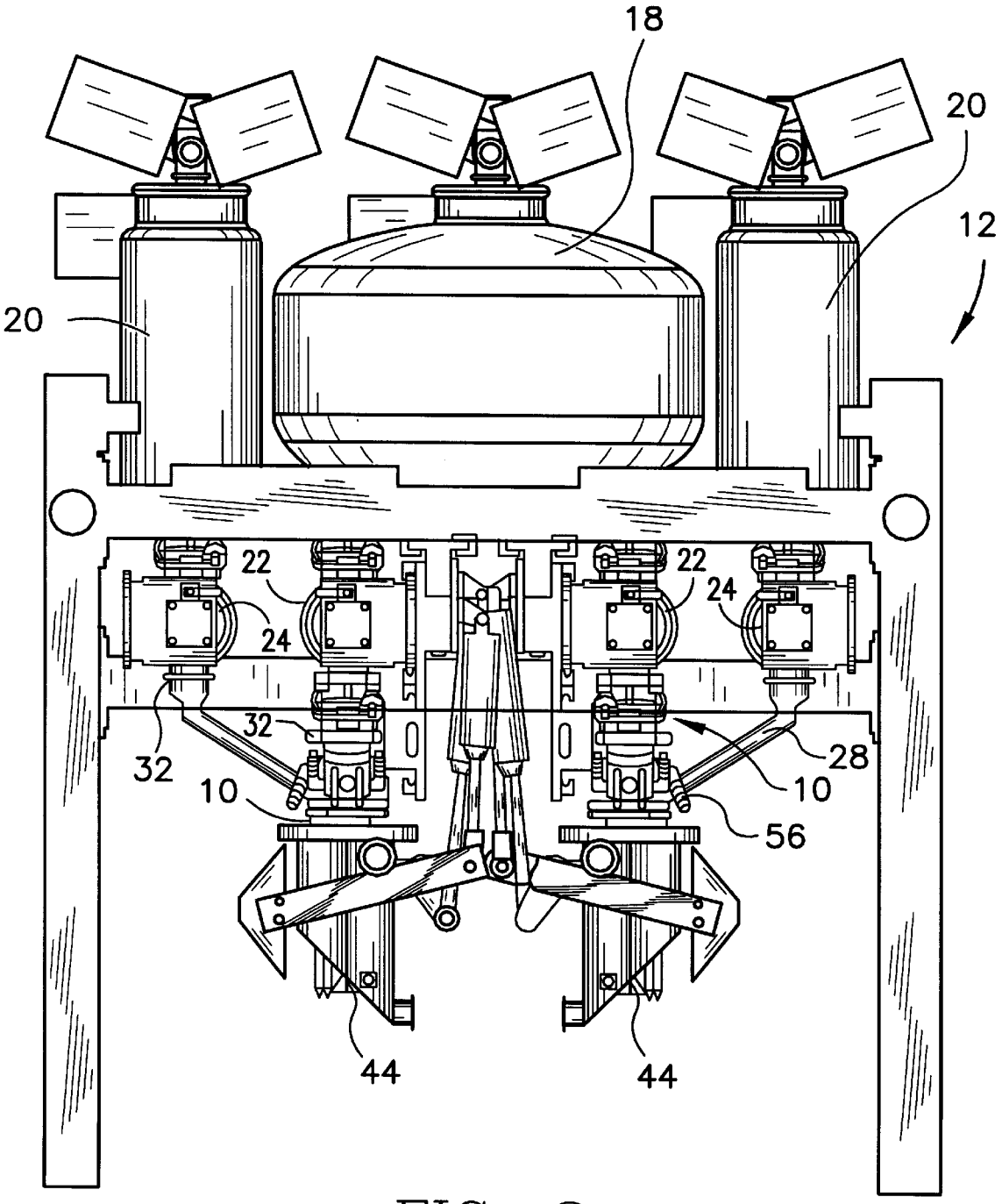
FIG. 2 is a general arrangement view of the filling station of a filling apparatus that includes a dual-stream filling valve.
Figure 3:
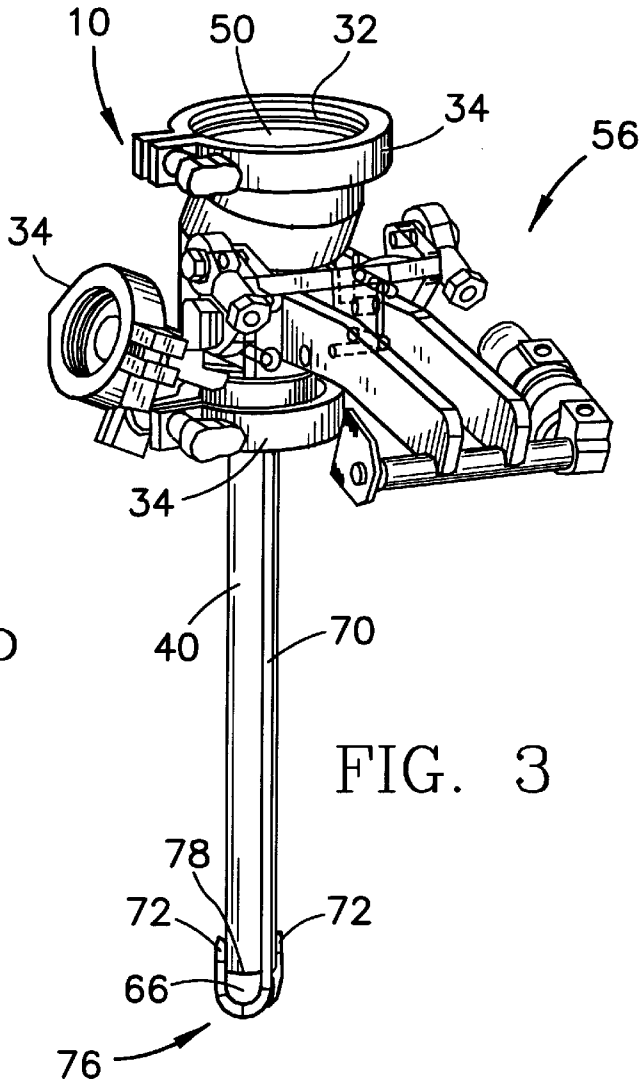
FIG. 3 is a perspective view of one embodiment of a dual-stream filling valve embodying the principles of the present invention, the filling valve including a hoop assembly and valve ball arrangement, the valve being illustrated with an exemplary universal product valve mounted atop the dual stream valve, and further illustrated with the outer, primary filling tube removed for clarity of illustration.
Figure 4B:
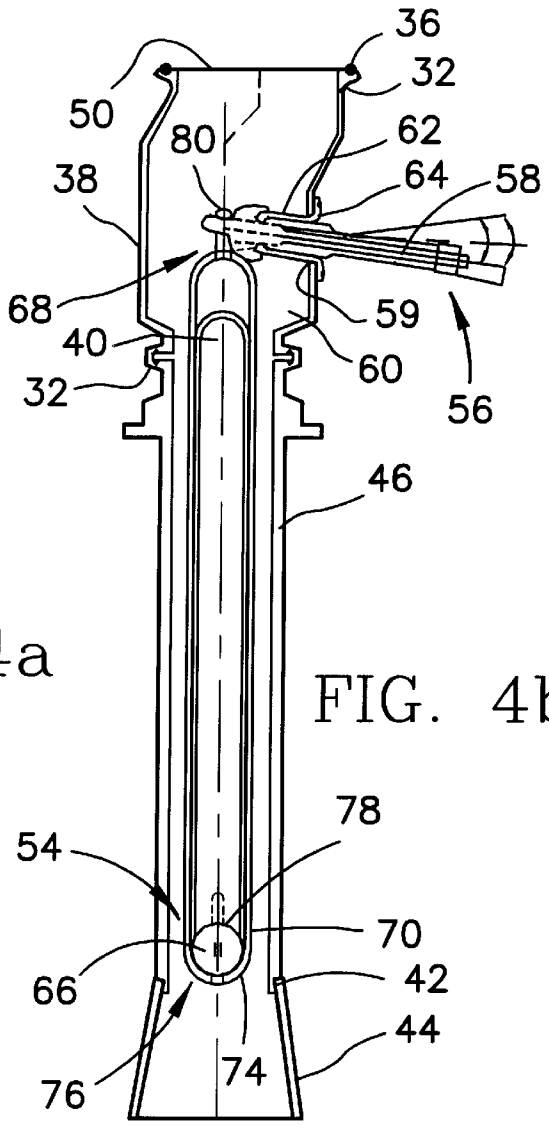
FIGS. 4*a* and 4*b* are partial cross-sectional front and side views, respectively, of the dual-stream filling valve of FIG. 3, with the primary filling tube in place, and with the valve in the closed position.
Figure 4A:
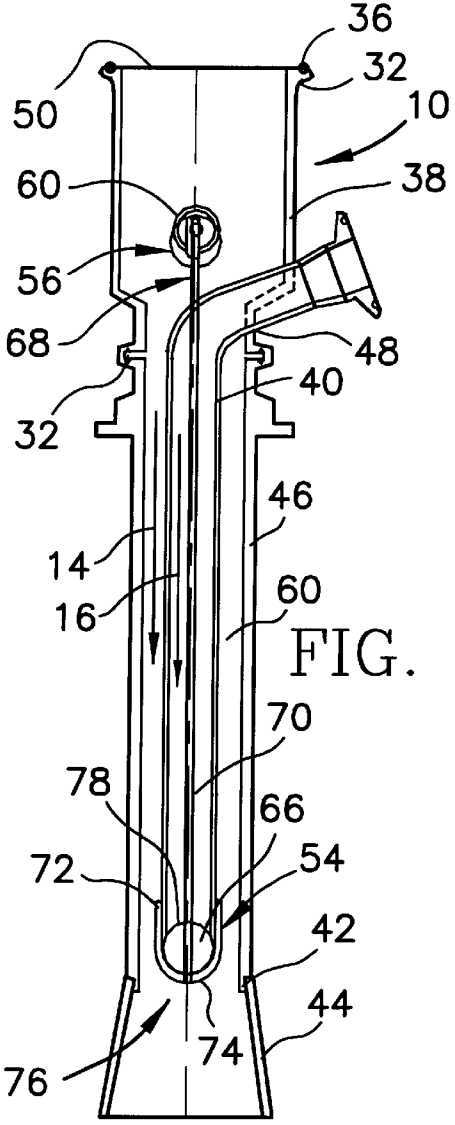

With reference now to the figures and in particular to FIGS. 2–4, there is shown one embodiment of a dual-stream filling valve 10 embodying the principles of the present invention. The valve 10 is illustrated installed within a filling apparatus 12. As noted above, the apparatus 12 may be used for packaging flowable materials, such as both skim milk and cream in a single container to produce milk having a specific, e.g., 2%, milk fat content. For purposes of the present discussion, the flow path for the skim milk will be referred to as the primary material or fill path, indicated at 14, and the flow path for the cream will be referred to as the secondary material or fill path, indicated at 16. The components within the primary and secondary fill paths 14, 16 will likewise be referred to as primary and secondary components.

It is to be understood that although specific reference to the present invention may be made relative to a liquid filling apparatus or for use in a liquid filling environment, use of the instant invention is not so limited. It is contemplated that the various embodiments of the present dual-stream filling valve can be used with any flowable material, including but not limited to solid materials, such as dried, particulate, powdered and granulated materials, as well as liquid products. It is further contemplated that packaging of combinations of such solid materials and liquid materials, for example, soups, can be carried out using the present invention. All such uses and combinations of packaged flowable materials are within the scope of the present invention.

FIG. 1 illustrates, schematically, the apparatus 12. FIG. 2 is one physical arrangement of such an apparatus 12. The apparatus 12 includes, generally, a primary product or material reservoir or storage tank 18, a secondary reservoir 20, primary and secondary material pumps, 22, 24, respectively, for the primary and secondary materials, and primary and secondary material transfer connections 26, 28 to transfer the respective flowable materials from the pumps 22, 24 to the dual-stream valve 10. The primary flow path 14 may include a resuction valve 30 that absorbs any pressure increase or spike as the flow of material into a container is terminated. This prevents the material from dripping or dropping during the periods following flow termination and between periods of material flow.

In a typical arrangement, the apparatus 12 components include flanges 32 that are clamped or connected to one another by dairy clamps 34. The flanges 32 may include seal elements, such as O-rings 36, to facilitate maintaining a seal between the components in the fill or flow paths 14, 16 and the environs.

The valve 10 includes primary and secondary, i.e., outer and inner concentrically disposed product transfer or filling tubes 38, 40, respectively. The outer or primary transfer tube 38 may carry, for example, skim milk, from the primary storage tank 18, while the inner or secondary tube 40 may carry, for example, cream from the secondary tank 20. In the present arrangement, the flowable materials can be mixed immediately prior to and as they are introduced into a common container. That is, the primary and secondary materials are mixed at about the discharge end 42 of the primary tube filling tube 38. Alternately, one of the materials can be first introduced into the container with the other material introduced subsequent thereto.

Various combinations of materials are intended to be produced using the present apparatus 12. For example, the primary and secondary storage tanks 18, 20 can contain skim milk and whole milk, respectively, to produce the desired end product. Alternately, the material in the tanks 18, 20 can be interchanged to produce other desired products. Also, as provided above, it is contemplated that other, non-liquid and partially-liquid flowable materials as well as combinations thereof, can be packaged using the present filling apparatus 12. Reference herein to flowable material, material, flowable product, product, and the like, shall be construed to include all such liquid, non-liquid and partially-liquid flowable materials, including both food products and non-food products.

Those skilled in the art will recognize that the primary filling tube 38 includes a filling nozzle 44 at the discharge end 42 thereof. The nozzle 44 conforms to the size and shape of the container that is being filled, as the flowable material exits the nozzle 44. Typically, such nozzles 44 are formed of a pliable material, such as a food grade, e.g., FDA approved, silicone rubber, and are configured to open outward to conform to the container opening upon initiation of product flow and to fold inward upon termination of product flow. The inward folding of the nozzle 44 minimizes any dripping or dropping of material from the tube 38 between filling of containers.

Figure 5B:
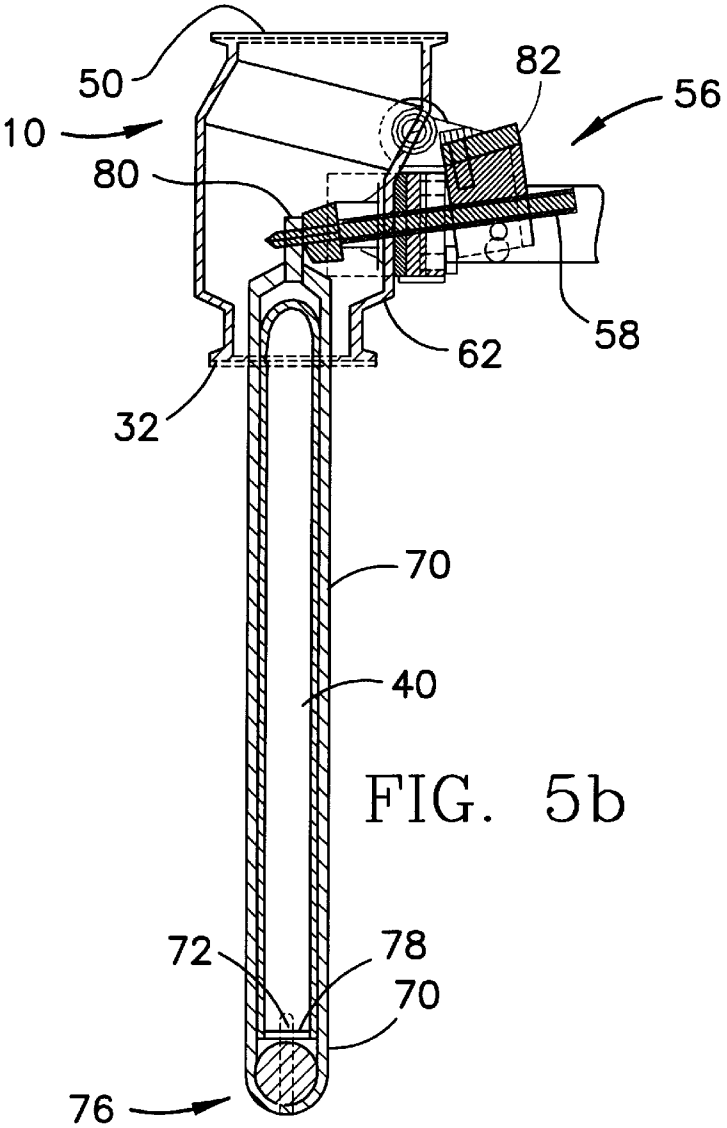
FIGS. 5*a* and 5*b* are partial cross-sectional side views of the dual-stream valve, similar to FIG. 4*b* but with the primary tube removed, showing the valve in the closed position and opened position in FIGS. 5*a* and 5*b,* respectively.
Figure 5A:
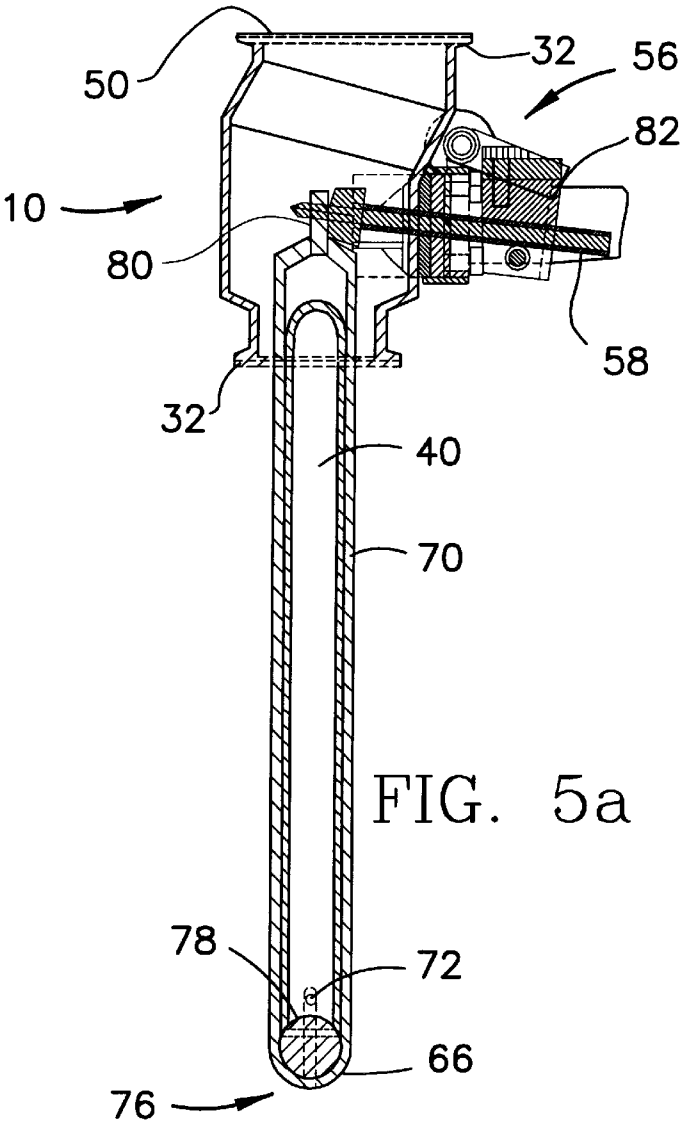

Referring now to FIGS. 3–5, the primary filling tube 38 has a main body portion 46 defining the flow path 14 through which the primary material flows from the pump 22 to the nozzle 44. The body 46 includes a secondary tube opening or penetration 48 therein that is positioned intermediate the primary tube 38 inlet and discharge ends, 50, 42, respectively, and is configured to receive the secondary tube 40. The penetration 48 is sealed about the secondary tube 40 to isolate the flow path 14 from the environs.

The secondary tube 40 has valve means 54 associated therewith. The valve means 54 and the secondary tube 40 move, at least in part, relative to one another to establish or initiate and terminate flow of the secondary material from the secondary tube 40. The valve means 54 can include, for example, a valve cone, such as a valve ball or plug. The valve means 54 lies in the material flow path 16. When the valve 54 is in the opened position or state, flow communication is established between the primary and secondary filling tubes 38 and 40, thus permitting material to flow from the secondary tube 40 to the primary tube 38. Conversely, when the valve 54 is in the closed position or state, flow communication, and thus material or product flow, between the primary and secondary tubes 38 and 40 is terminated.

In one embodiment, as best seen in FIGS. 3–5, the primary and secondary filling tubes 38, 40 are essentially rigid structures. The secondary tube 40 is fixedly mounted to the primary tube body 46. The valve means 54 includes an actuator 56 having a valve lever 58 that penetrates the primary tube body 46 at a penetration 59 that is intermediate the secondary penetration 48 and the inlet end 50 of the primary tube 38. The valve lever 58 extends into the primary tube flow region 60 and pivots generally longitudinally along the flow path 14. The lever 58 is positioned and pivots within a sleeve-like element 62 that extends from a diaphram seal 64, into the primary flow path 14. The seal 64 and sleeve 62 isolate the portion of the lever 58 internal to the primary tube 38, and thus the primary material from the environs.

The lever 58 is operably connected to the valve means 54 to establish and terminate flow from the secondary filling tube 40. In a current embodiment, the valve means 54 is a valve ball 66 that is operably connected to the lever 58 by an actuating rod assembly 68. The valve ball 66 is formed of a polymeric material, such as the aforementioned silicone. Silicone has been found to be an ideal material for this application because of its ability to conform to the tube 40 opening thus creating a liquid-tight or material-tight seal, and because of its hygienic, e.g., clean-ability, characteristics.

The rod assembly 68 can include a rectangular hoop 70 that extends along two sides, or 180° about the secondary filling tube 40, as seen in FIGS. 3–4, and can include J-shaped members 72 that extend from the base 74 of the hoop 70, essentially forming a rod cage 76. The cage 76 is configured to essentially "ride" along the outside of the secondary tube 40. A distance or gap of about ¼ mm between the rods 70, 72 and the tube 40 is anticipated to be sufficient to prevent binding of the rods 70, 72 and tube 40, while permitting free, guided movement of the rods 70, 72. In this manner, the valve ball 66 is surrounded at 90° intervals by the rod cage 76, and the ball 66 can freely rotate within the cage 76.

Advantageously, permitting the ball 66 to freely rotate enhances the ability of the ball 66 to seal the secondary tube 40. Because the ball 66 rotates, the area of the ball 66 that is subject to compression against the secondary tube discharge end 78 will likely change from one compression to the next. Thus, free rotation of the ball 66 distributes compression on the ball 66 over more of the surface of the ball 66 and subjects it to less localized wear as a result of the continuous compression of the softer, resilient ball 66 against the secondary tube 40. Moreover, it is contemplated that free rotation of the ball 66 will increase the ability of the ball 66 to "self-clean." That is, there will be less accumulation or build-up of product on the ball 66, thus reducing the opportunity for improper seating of the ball 66 at the tube discharge end 78.

The rod assembly 68 includes a connecting member 80 that is adapted to receive the lever 58. The connecting member 80 and lever 58 are configured such that, as the lever 58 is pivoted, the rod cage 76 is moved toward and away from the secondary tube discharge end 78. As the cage 76 is moved toward and away from the discharge end 78, the ball 66 seats and unseats from the tube 40.

Advantageously, the valve ball 66 is also self aligning. That is, even if the ball 66 is slightly off of center as it is brought into contact with tube 40, the spherical shape of the ball 66 will cause it to shift or move into alignment with the discharge end 78 and form a seal thereacross. Other valve cone shapes and valve types, such as those disclosed herein, as well as standard plugs or plug-cocks, truncated plug-cocks, flap-type valves and the like can also be used with the rod assembly 68 arrangement. Such other shapes and configurations of valve plugs are within the scope of the present invention.

The lever 58 is actuated by an external drive 82 that is isolated from the flowable material. In this manner, the hygienic standards of the "wetted" or "contacted" apparatus 12 components can be more readily maintained if necessary or desired. This is particularly suitable for use of the apparatus 12 in packaging food products or the like. The manner of actuating the lever 58 can include mechanical drives, electromechanical drives, hydraulic and pneumatic drives. Such drives, and their use and application, will be readily recognized by those skilled in the art.

As is apparent from the figures and the above description of this embodiment of the dual-stream filling valve 10, the primary and secondary filling tubes 38, 40 are essentially rigid, fixed flowable material carrying conduits. To effectuate actuation, the valve ball 66 and secondary tube 40 move relative to one another. This arrangement provides a valve ball 66 that is readily accessible for maintenance and inspection by removing the mechanical components of the actuating assembly 68.

Figure 6B:
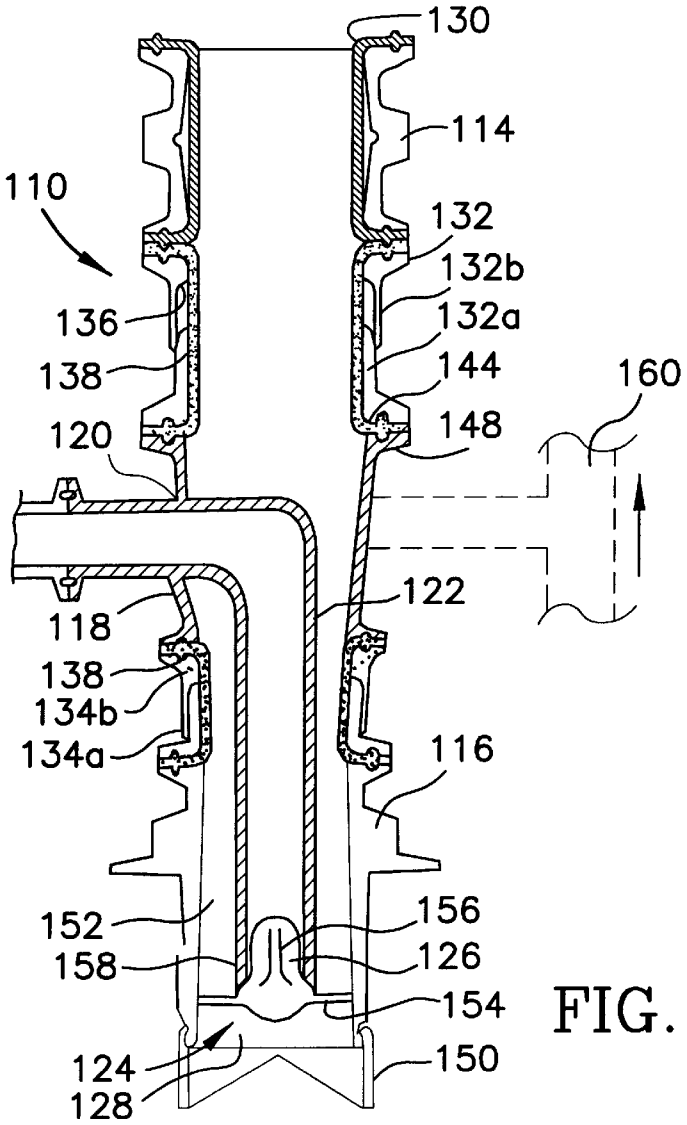
FIGS. 6*a* and 6*b* illustrate another embodiment of the dual-stream valve embodying the principles of the present invention, the valve being shown in the opened and closed positions, respectively.
Figure 6A:
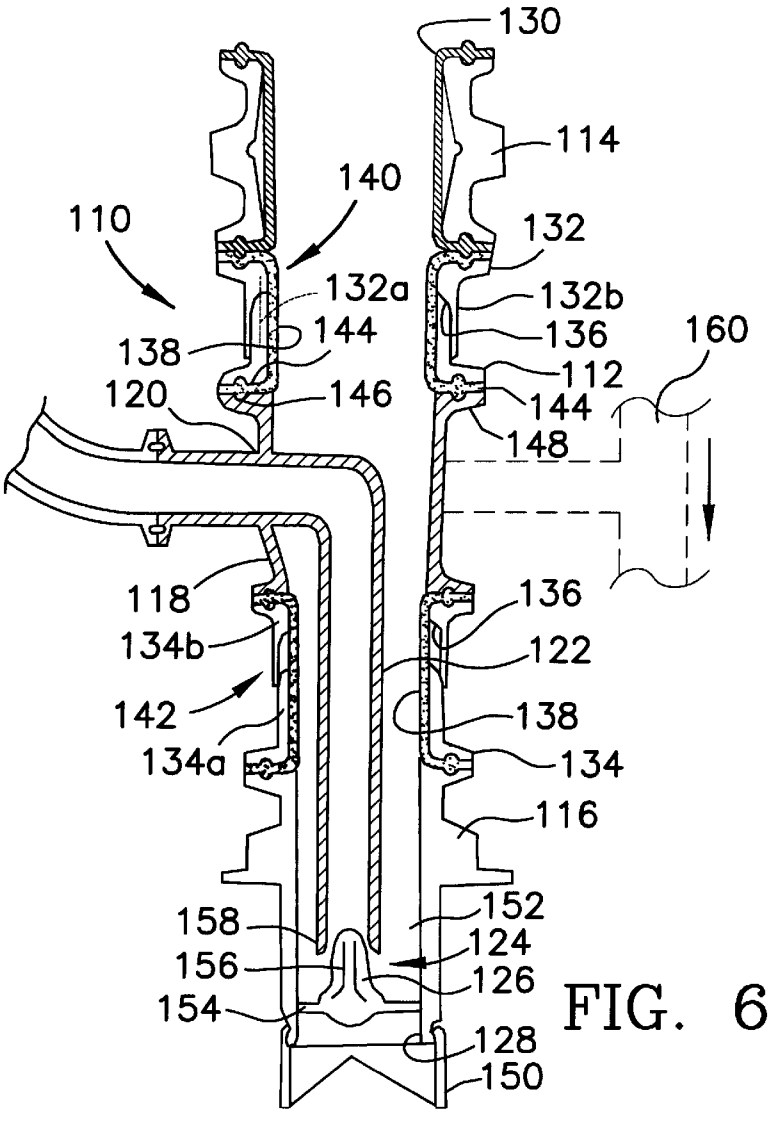
Figure 9:
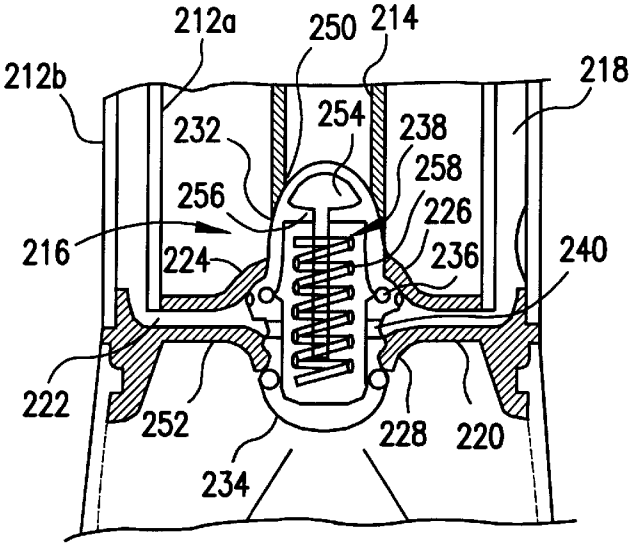
FIG. 9 is an enlarged view of the valve plug of the embodiment of the valve illustrated in FIG. 7.

An alternate embodiment of the dual-stream filling valve 110 is illustrated in FIGS. 6*a* and 6*b*. In this embodiment, the primary tube 112 includes first and second, e.g., upper and lower stationary body portions 114, 116 and an intermediate housing portion 118 positioned between the upper and lower body portions 114 and 116. The intermediate housing 118, which includes an opening or penetration 120 for the secondary tube 122, reciprocates between, and relative to, the upper and lower body portions 114 and 116. Valve means 124, such as the illustrated valve cone 126, is fixedly mounted to one of the stationary body portions 114, 116, preferably, the lower body portion 116.

With reference to FIGS. 6*a* and 6*b*, as the intermediate housing 118 reciprocates, the secondary tube 122 likewise reciprocates, and is moved into and out of contact with the valve cone 126. For example, when the intermediate housing 118 is moved downward (FIG. 6*b*), toward the discharge end 128 of the primary tube 112, the secondary tube 122 moves into contact with the valve cone 126, and the flow of material therefrom is terminated. Conversely, when the intermediate housing 118 is moved upwardly (FIG. 6*a*), toward the inlet end 130 of the primary tube 112, the secondary tube 122 is moved out of contact with the valve cone 126. In this position, the valve 124 is open, thus establishing flow communication between the primary and secondary tubes 112, 122.

The upper body portion 114 and intermediate housing 118 and the intermediate housing 118 and lower body portion 116 are connected to one another by cooperating, moving connectors or joints 132, 134. The joints 132, 134 permit the intermediate housing 118 to reciprocate relative to and between the fixed upper and lower body portions 114, 116. In this configuration, with the secondary filling tube 122 fixedly mounted to the intermediate housing 118, the secondary tube 122 likewise reciprocates relative to the upper and lower body portions 114, 116.

As best seen in FIGS. 6*a* and 6*b*, each sliding connector 132, 134 includes an inner slide member 132*a*, 134*a* and an outer slide member 132*b*, 134*b* that are concentric relative to one another. The inner slide members 132*a*, 134*a* are configured to slide, in a telescopic manner within their respective outer members 132*b*, 134*b*. The outer members 132*b*, 134*b* each include a stop or end wall 136 to prevent the inner members 132*a*, 134*a* from over-inserting into the outer members 132*b*, 134*b*.

The sliding members 132, 134 are isolated from the flowable material by seal elements 138, such as the illustrated flexible diaphrams. The diaphrams 138 flex as the joints 132, 134 slide between the retracted state, as illustrated at 140, and the extended state, as illustrated at 142. The diaphrams 138 are retained in place by rings or lips 144 integral with the diaphrams 138 that are positioned in grooves 146 formed in the flanges 148. As the flanges 148 are compressed together, the diaphrams 138 are secured in place.

In a typical arrangement, as discussed above, the components are clamped together at the flanges 148 by dairy clamps (see clamp 34, in FIG. 3). The clamps 34 maintain the components of the apparatus 12 rigid and the material flow path isolated from the environs. The diaphram 138, like the valve nozzle 150 is formed of a food-grade material, such as silicone rubber. The diaphram 138 material is formulated with sufficient elasticity so that the diaphram 138 will withstand repeated and continuous flexing as the intermediate housing 118 and secondary filling tube 122 are reciprocated. Thus, the hygienic standards that may be required or deisred for the process can be readily achieved and maintained, while isolating the moving connectors 132, 134 from the flowable product.

FIGS. 6*a* and 6*b* illustrate the valve 110 with the valve in the opened and closed positions, respectively. As is apparent from the figures, the joints 132, 134 are similarly oriented and cooperate with one another to permit the intermediate housing 118 to reciprocate within a fixed linear space. Thus, when one of the joints, for example the upper joint 132, is in the extended position (as shown in FIG. 6*b*), the other joint 134, is in the retracted position. In this manner, both joints' 132, 134 like members 132*a*, 134*a* are in continuous contact with their respective joints' other like members 132*b*, 134*b*. This maintains the structural stability and rigidity of the valve 110. In a current embodiment, the intermediate housing 118 reciprocates between about 10 millimeters (mm) and 13 mm, from the top of stroke or opened position as shown in FIG. 6*a*, to the bottom of stroke or closed position as shown in FIG. 6*b*.

An exemplary valve cone 126 is illustrated in place in the valve 110 in FIGS. 6*a* and 6*b*. The cone 126 is a resilient member that is formed of, for example, a silicone rubber, similar to the other non-metallic, wetted, silicone components. The valve cone 126 is supported in place in the primary flow chamber 152 by a plurality of rigid support elements 154 that extend inwardly from the inside surface of the primary filling tube 112. The elements 154 are positioned about the primary tube flow chamber 152 so as to minimize interfering with the flowing material.

In one embodiment, the cone 126 includes guide means 156 to maintain the cone 126 in alignment with the secondary tube 122. The guide means can include the ribs 156 as shown on the cone 126 of FIGS. 6*a* and 6*b*, to facilitate proper seating of the reciprocating secondary tube 122 with the cone 126.

Figure 10:
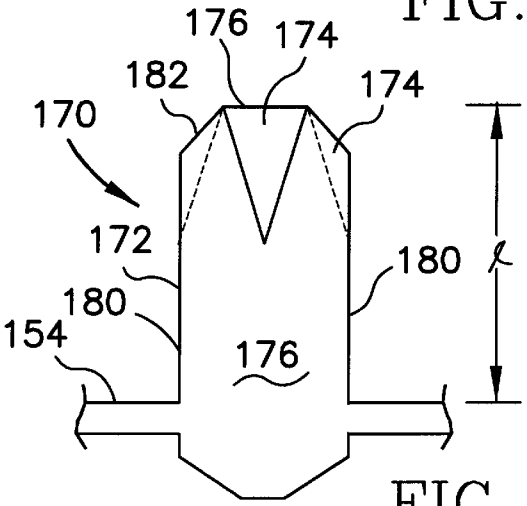
FIG. 10 is a side view of an exemplary valve plug or cone that can be used with the embodiment of the valve shown in FIGS. 6*a* and 6*b*.

Another exemplary cone 170, referred to as a V-groove cone 170, is shown in detail in FIG. 10, the V-groove valve cone 170 includes a cylindrical, barrel-like main body portion 172. The cone 170 has a plurality of V-shaped, angled grooves as indicated at 174 formed in the body 172. The angling of each groove 174 is such that the cross-sectional area of the groove 174 is greatest at the top 176 of the cone 170 and decreases downward, along the length l of the cone 170 and the groove 174. The grooves 174 have a V-shape as viewed from the front and sides 178, 180 of the cone as seen in FIG. 10, and as seen from the top 176 of the cone 170. Alternately, the grooves 174, as viewed from the top 176 of the cone 170, can have a curvilinear cross-section, such as quarter-circular, semi-circular and parabolic shaped cross-sections. All such cross-sectional shapes are within the scope of the present invention.

It has been observed that such a V-groove 174 configuration provides enhanced flow control characteristics. In the illustrated V-groove configuration 174, the cone 170 resides within the discharge end 158 of the secondary tube 122, when in the closed position, thus maintaining alignment of the cone 170 and tube 122. The cone 170 includes guide or alignment means to maintain the cone 170 in alignment with the secondary tube 122 as they are engaged with one another. Such guide means can be internal to the tube 122 or external to the cone 170.

In the cone 126 illustrated in FIGS. 6*a* and 6*b,* alignment of the cone 126 and tube 122 is effected by the ribs 156 that extend outwardly from the cone 170. Alternately, as shown in the cone 170 of FIG. 10, alignment can be maintained by a beveled edge or chamfer 182 along the top 176 and sides 180 of the cone 170. Those skilled in the art will recognize the various means that can be used maintain alignment of the secondary tube 122 and these cone 126, 170 configurations, as well as other cone configurations.

The intermediate housing 122 can be reciprocated by any of a variety of drive means 160, including mechanical drives, electromechanical drives, hydraulic and pneumatic drives. Such drives, and their use and application, will be readily recognized by those skilled in the art. The use of all such drives are within the scope of the present invention.

Figure 8:
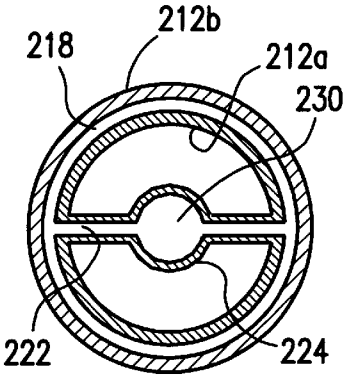
FIG. 8 is a cross-sectional view of the valve of FIG. 7, taken along line 8—8 of FIG. 7.
Figure 7:
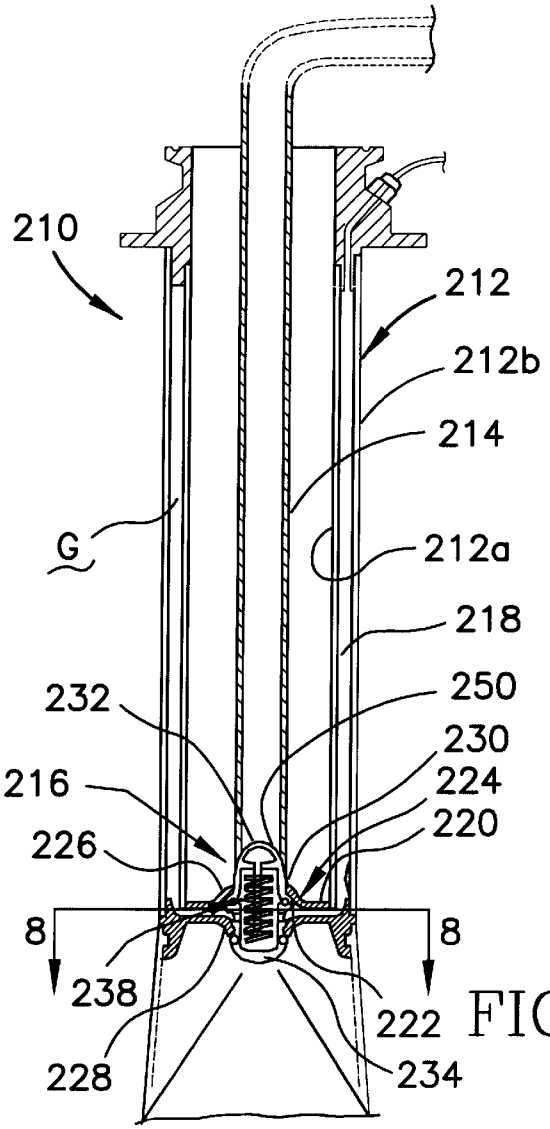
FIG. 7 is still another embodiment of the dual-stream valve that uses an external pressure or vacuum source for cycling the valve.

Still another embodiment of the dual-stream filling valve 210 is illustrated in FIG. 7. In this embodiment, the primary and secondary tubes 212, 214 are stationary relative to one another. The valve means, such as the illustrated valve plug 216, is fixedly mounted within the tubes 212, 214. The primary tube 212 has inner and outer portions 212*a,* 212*b,* respectively, that define a sealed passage or space 218 therebetween. The inner portion 212*a* includes an inwardly extending portion 220 that defines a pressure passage conduit 222. Referring to FIG. 8, the conduit 222 extends inwardly of the inner portion 212*a* to form an annular pressure manifold 224. The manifold 224 includes upper and lower flanges 226, 228, respectively that define a central plug receiving region 230. In a present embodiment, the pressure passage conduit 222 extends from two opposing sides of the inner portion 212*a,* 180° from one another to define the manifold 224.

The valve 210 includes a pressure actuated plug portion 216. The plug 216 includes a flexible seat element 232 and an opposingly oriented rigid cap portion 234. The seat element 232 and cap portion 234 are positioned within the manifold 224, in the plug receiving region 230. An O-ring or like seal 236 is disposed between the cap 234 and seat element 232 to form an air-tight or vacuum-tight seal therebetween and to define a pressure region 238 within the plug 216. The plug 216 is positioned in the manifold 224 between and mounted to the upper and lower flanges 226, 228. The cap portion 234 and lower flange 228 can include complementary threads to retain the plug 216 in place in the manifold 224. The cap 234 includes pressure ports 240 that open to the manifold 224 and the pressure region 238.

The seat element 232 is flexible, and extends upwardly from the manifold 224. In the extended state, the seat element 232 engages the discharge end 250 of the secondary filling tube 214. A pin 252 is positioned within the plug 216 and includes a head portion 254 that resides within the plug 216, between the top wall of the seat element 232 and an inwardly extending lip 256. A biasing member 258, such as the exemplary, illustrated coil spring, is positioned about the pin 252.

The spring 258 is biased to the opened position of the plug 216. That is, when the pressure in the pressure region 238 is lower than the force exerted on the seat element 232 by the spring 258, the pin 252 is urged downwardly by the spring 258 force. This disengages the seat element 232 from the secondary tube 214 and opens the secondary tube discharge end 250 to permit the flow of material therefrom.

Conversely, pressure is applied to the pressure region 238 by air, nitrogen or a like gas G to close the plug 216. The gas G is provided to the sealed passage 218 through a tap 260 or the like. The gas G flows through the passage 218 and into the manifold 224. The gas G from the manifold 224 enters the plug pressure region 238 through the ports 240 and pressurizes the region 238. The pressure in the region 238 forces the seat element 232 upward against the force of the spring 258 into contact with the secondary tube discharge region 250, thus terminating flow from the tube 214.

As provided above, it is anticipated that compressed air, nitrogen or a like gas G will be used to pressurize the pressure region 238 to close the plug 216. Alternately, it is anticipated that a liquid, e.g., hydraulic, system can be used to pressurize the plug 216. Such a liquid system can include use of a liquid product if it is being processed in the apparatus 12, as well as hydraulic fluids and other systems that will be recognized by those skilled in the art.

Alternately, the plug 216 can be actuated using a vacuum system (not shown). In such a system, the spring 258 would be configured to bias the valve 216 into the closed position; that is, the spring 258 would be configured to urge the seat element 232 into contact with the secondary tube discharge end 250. Similar to the application of pressure to close the valve 216, a vacuum applied to the passage 218 and manifold 224 would draw a vacuum in the pressure region 238. The vacuum, in turn, would urge the seat element 232 downward, against the force of the spring 258 and out of contact with the discharge end 250, thus opening the secondary tube 214 to permit material to flow therefrom.

Conversely, when the vacuum in the pressure region 238 is reduced, the force exerted on the seat element 232 by the spring 258 will urge the seat element 232 upward into contact with the secondary tube discharge end 250, to terminate flow from the tube 214.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A dual-stream filling valve for use with a flowable material filling apparatus for introducing at least two flowable materials into a container, the dual-stream filling valve defining a material flow path, the valve comprising:

a primary filling tube having an inlet end and a discharge end and defining a primary filling tube internal flow region, the primary filling tube having a first opening therein intermediate the inlet and discharge ends, and a second opening;

a secondary filling tube having an inlet end and a discharge end and defining a secondary filling tube internal flow region, the secondary filling tube being disposed at least in part within the primary filling tube internal flow region, the secondary filling tube penetrating the primary filling tube through the first opening wherein the primary and secondary filling tubes are stationary relative to one another;

valve means positioned in the primary filling tube internal flow region and including a portion that is movable relative to the secondary filling tube between an opened state wherein flow communication is established between the internal flow regions of the primary and secondary filling tubes and a closed state wherein flow communication is terminated between the internal flow regions of the primary and secondary filling tubes; and an actuating lever extending at least in part through the second opening in the primary filling tube and penetrating the primary filling tube intermediate the first opening and the inlet end, the actuating lever operably connected to the portion of the valve means to move the portion of the valve means between the opened and closed positions, the actuating lever being disposed fully external of the secondary filling tube flow region.

2. The dual-stream filling valve in accordance with claim 1 further comprising a connecting member to support the portion of the valve means, the connecting member extending between the actuating lever and the portion of the valve means.

3. The dual-stream filling valve in accordance with claim 2 wherein the connecting member comprises a caged rod assembly.

4. The dual-stream filling valve in accordance with claim 3 wherein the valve means comprises a valve ball.

5. The dual-stream filling valve in accordance with claim 4 wherein the valve ball is self-aligning relative to the secondary filling tube.

* * * * *